US007174970B2

(12) United States Patent
Kremer

(10) Patent No.: US 7,174,970 B2
(45) Date of Patent: Feb. 13, 2007

(54) VIBRATORY DAMPED GUIDE LEVER FOR A WORKING DEVICE

(75) Inventor: Klaus Kremer, Lehmen (DE)

(73) Assignee: Bomag GmbH, Boppard (DE)

( * ) Notice: Subject to any disclaimer, the term of this patent is extended or adjusted under 35 U.S.C. 154(b) by 0 days.

(21) Appl. No.: 11/062,866

(22) Filed: Feb. 23, 2005

(65) Prior Publication Data

US 2005/0207842 A1 Sep. 22, 2005

(30) Foreign Application Priority Data

Mar. 1, 2004 (DE) ..... 10 2004 009 989
Mar. 30, 2004 (DE) ..... 10 2004 015 588

(51) Int. Cl.
*E02D 7/18* (2006.01)
*E02D 3/046* (2006.01)
*E02D 3/068* (2006.01)

(52) U.S. Cl. ..... 173/49; 173/48; 404/133.1

(58) Field of Classification Search ..... 173/49, 173/50, 51, 48; 172/40; 404/133.1, 133.05, 404/102

See application file for complete search history.

(56) References Cited

U.S. PATENT DOCUMENTS 3,314,341 A 4/1967 Schulin et al. ..... 94/48
3,427,939 A * 2/1969 Fox et al. ..... 404/133.2
3,782,845 A * 1/1974 Briggs et al. ..... 404/133.1
3,917,426 A * 11/1975 Wohlwend et al. ..... 404/133.2
4,224,003 A * 9/1980 St. Louis ..... 404/133.2
4,412,757 A * 11/1983 Kummel et al. ..... 404/113
4,966,499 A * 10/1990 St. Louis ..... 405/271
5,957,622 A * 9/1999 Vera-Montiel ..... 404/133.1
6,551,022 B1 * 4/2003 Stayner ..... 404/133.1

FOREIGN PATENT DOCUMENTS

| | | |
|---|---|---|
| CH | 426660 | 12/1966 |
| DE | 2132700 | 1/1972 |
| EP | 1099796 A2 | 5/2001 |
| JP | 11036219 | 2/1999 |

* cited by examiner

*Primary Examiner*—Rinaldi I. Rada
*Assistant Examiner*—Nathaniel Chukwurah
(74) *Attorney, Agent, or Firm*—Baker & Hostetler LLP

(57) ABSTRACT

The invention concerns a hand-operated working device such as, for example, vibrating plates and vibrating rollers for soil compaction with a guide lever that is arranged on the working device such that it is vibratory damped, can be adjusted in its working height, and can be folded and fixed in a transport position. It has an elastic damping element on each of the four junctures distributed in the arrangement. All four damping elements are connected on the side turned away from the device to a console. The guide lever is arranged on the console.

9 Claims, 4 Drawing Sheets

VIBRATORY DAMPED GUIDE LEVER FOR A WORKING DEVICE

CROSS REFERENCE TO RELATED APPLICATIONS

This application claims priority to German Patent Application Serial No. 102004009989.8, filed Mar. 1, 2004 and German Patent Application Serial No. 102004015588.7 filed Mar. 30, 2004 titled, VIBRATORY DAMPED GUIDE LEVER FOR A WORKING DEVICE, the disclosure of which is incorporated by reference in its entirety.

FIELD OF THE INVENTION

The invention concerns a hand-operated, automotive working device, for example, a vibrating plate, a vibrating roller and such for soil compaction with a vibratory damped guide lever.

BACKGROUND OF THE INVENTION

Small-structured, automotive working devices for soil compaction of the afore-mentioned type are controlled by one operating person who walks with the working device. The operator steers the device in the direction of movement and controls the device functions by means of a guide lever. The guide lever is usually designed as a height-adjustable drawbar. The control and operating elements are arranged on the head of the drawbar.

Since vibrations emanate from such working devices, particularly dynamic compacting machines, the guide levers must be designed to be vibratory damped. The use of elastic materials for this purpose, preferably the use of the so-called rubber-metal combinations has proved to be advantageous. Such elements have good damping characteristics particularly in the case of shearing loads.

Known design forms of the combinations of the working device and the guide lever load the damping elements preferably in the axial direction. The overlaying stress that is mostly present (pressure, shearing, torsion) is not suitable for achieving good damping characteristics.

Also another arrangement is known in which the damping elements are arranged coaxial to each other. Here the guide lever is connected via an intermediate component to both the damping elements. However, the disadvantage of the layout that provided technical protection from vibrations is that the steering efforts have to be transferred to the working device via the damping elements and this essentially leads to increased stresses.

In accordance with a suggestion in CH 426 660 a metallic component should be additionally inserted below the damping equipment in such an arrangement. The metallic component should be able to accommodate the guide lever (drawbar) in a slot-shaped recess. In order to transfer steering efforts in such an arrangement the guide lever leans against the side surface of the recess and transmits the steering efforts directly. The disadvantage is that during the application of steering forces the decoupling of the vibrations of the working device is adversely affected. Other disadvantages are the additional guide component increases the costs of the device and works only in a limited angular range.

The combination of the guide lever with the damping elements simultaneously forms the setting device for the guide lever. For a desirable adjustment of the setting angle of the guide lever to ergonomic conditions it is necessary to detach the fixed connection of the guide lever to the damping elements and to reattach it after readjustment. Otherwise an adjustment of the position is possible only in the corresponding length of the guide lever by applying external forces and the consequent torsion of the damping elements. The existing technical conditions call for either an optimized layout in relation to the vibration damping or an increased mobility of the guide lever.

SUMMARY OF THE INVENTION

Therefore the task of the invention is to suggest a guide lever for hand-operated working devices that can be adjusted and readjusted to an ergonomically favorable position. In case of a dangerous situation the guide lever can be quickly moved out of its working position into a safe position. It can be folded and stored during the transport of the working device. The guide lever in accordance with the invention enables a good vibration damping without adversely affecting the controllability of the working device. Furthermore it can be operated robustly and cost-efficiently.

In accordance with the invention the working device is connected to the guide lever on four points on the working device. The four junctures are distributed such that a quadratic arrangement is formed. A damping element is arranged on each of the four junctures. The centerline of the damping elements is arranged such that every two damping elements are arranged coaxial to each other.

The junctures can be arranged on the framework of a working device, on an additional component assembly of the working device or on an intermediate component.

The damping elements are connected to a console via the free junctures. Preferably the console overlaps the entire arrangement of the damping elements. A unit that is suitable for the accommodation of a guide lever is arranged on the topside of the console. The guide lever is connected via said unit to the console and with this to the working device. The guide lever is preferably connected to the console via a jointed connection.

In a preferred embodiment of the invention the guide lever that can be designed as a drawbar is connected to the console by a joint.

In another embodiment of the invention the guide lever can be deviated from the working position, folded upwards and fixed in this position (transport position) by means of a retaining element. All suitable technical means can be used as retaining elements, of which pins, screw joints, bolts, detent index or clamps are preferred.

A stop can be arranged additionally in the working position in accordance with another embodiment of the invention. The stop is used for the purpose of fixing the height of the guide lever so as to make it ergonomically advantageous to the operator. It is possible to design the stop such that it is also adjustable. Thus it is possible to individually adjust the working position of the guide lever.

Another embodiment of the invention uses a stop whose elements determining the end position are provided additionally with damping elements and/or the stop itself is damped. The damping elements can also be arranged on the contact zone of the guide lever. In this way the vibration damping of the guide lever can be further improved while simultaneously avoiding an undesired noise development between the guide lever and the stop.

The overall layout makes it possible to arrange the damping elements with suitable dimensions such that steering efforts act evenly on all four damping elements without causing any overloading. It is unnecessary to have a stiff connection between the guide lever and the working device. During the working process the vibrations of the working device are decoupled via the damping elements that are stressed almost exclusively by shear forces. Due to the guide lever that is designed such that is can be deviated and folded, a space-saving rest position and/or transport position is possible by fixing the guide lever. Furthermore, in dangerous situations the guide lever can be tilted upward and folded. Due to a continuously variable adjustment of a stop that is additionally provided with dampers, an ergonomically advantageous position of the guide lever is possible.

BRIEF DESCRIPTION OF THE DRAWINGS.

The invention is elaborated in more detail on the basis of a design form illustrated in the drawing. The figures illustrate schematically.

DETAILED DESCRIPTION.

Figure 1:
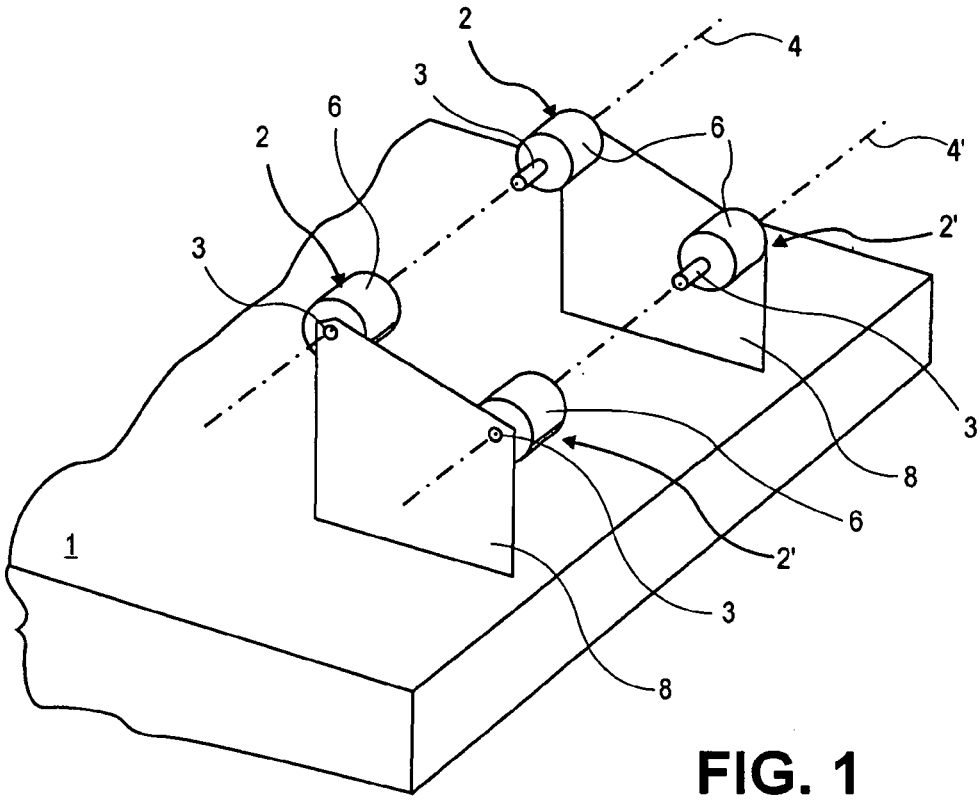
FIG. 1 the arrangement of connection points for a guide lever on a working device.

FIG. 1 is a schematic illustration of an automotive working device 1 for dynamic soil compaction. The working device 1 is operated by an operator who walks along the device. Examples of such devices include a vibrating plate, a unicycle vibrating roller or a double vibrating roller. Four connection points are arranged on its framework. They are each provided with a bearing 2,2' for a hand-operated guide lever (drawbar) 15 (FIGS. 2, 4, 5) for the operator. The bearings 2, 2' are arranged in the corners of a rectangle.

As FIG. 1 illustrates, two bearings 2, 2' are designed on bearing blocks 8 that are located on the side of the machine. The bearings are provided with attachment bolts 5 for holding the damping elements 6 via which the guide lever 15 is connected to the working device 1. The damping elements 6 are aligned pairwise along the imaginary diagonal axes 4, 4' that extend parallel to the cross direction of the working device 1. The distance between the bearings 2, 2' along the diagonal axis 4, 4' is selected to be as large as possible.

Figure 2:
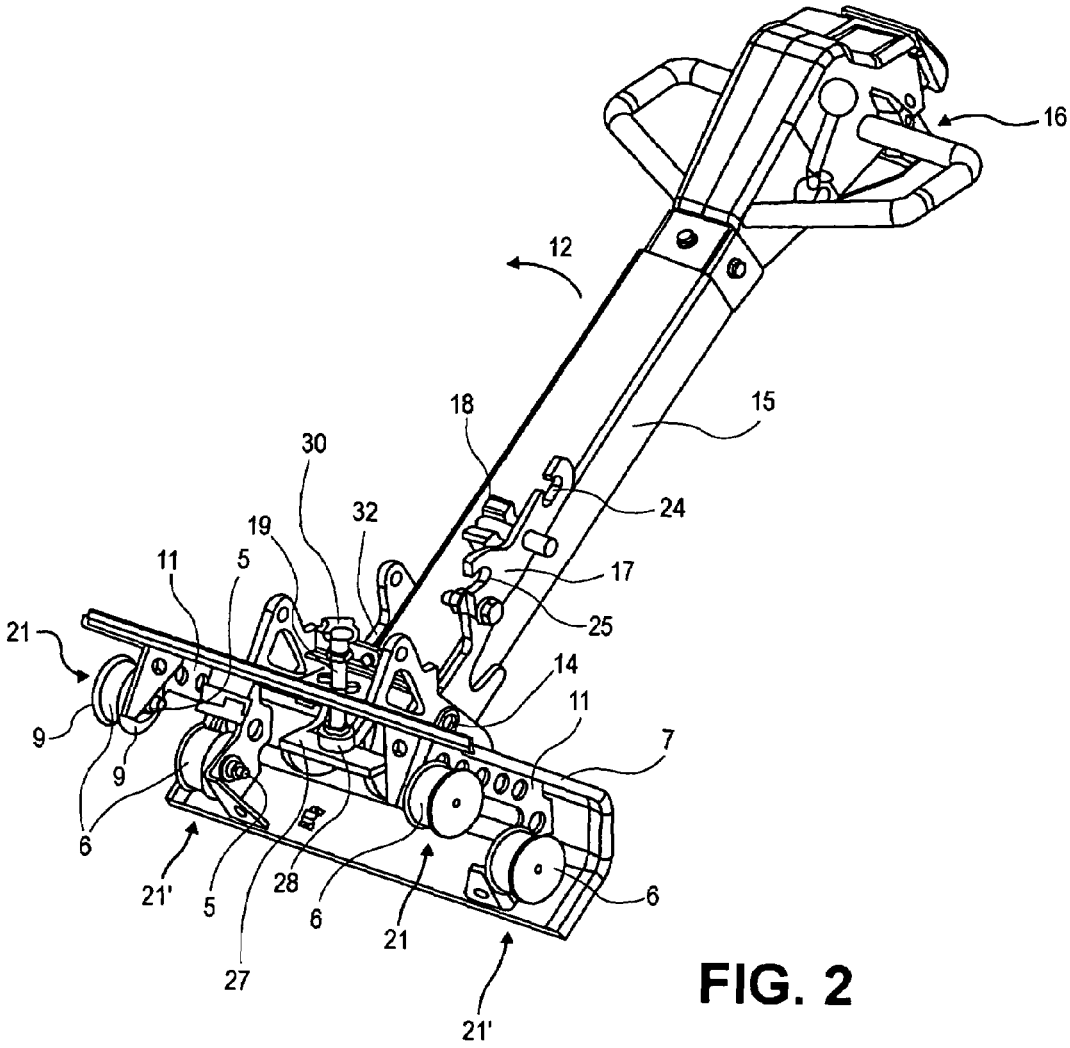
FIG. 2 a perspective view of a guide lever in a working position.

In accordance with FIG. 2 the transfer of vibrations generated by the working device 1 on the guide lever 15 is stopped as far as possible using the damping elements 6. The guide lever 15 is designed as a swiveling drawbar that is linked in its root point to a console 7 for adjusting the working height and assuming a transport position. The guide clamp and operating elements 16 are located on the head of the drawbar. The console 7 has the function of a stiff base framework in order to accommodate all elements necessary for the attachment and linkage of the guide lever 15.

Two additional parallel bearing blocks 11 are located on the console 7 with altogether four counter bearings 21, 21' for the bearings 2, 2' that are located on the machine side. Each bearing 2, 2' located on the side of the machine is connected to each counter bearing 21, 21' by each of the damping elements 6. The four damping elements 6 are designed as rubber pads with metal discs 9 on both front faces. They lie with their inner front faces on the bearing blocks 11 located on the side of the console and lean with their outer front faces against the bearing block 8 that is located on the machine side. The four damping elements 6 are held via the bolts 5 that are pushed through the counter bearing 21, 21' by the damping elements 6. In the longitudinal direction of the guide lever 15 the damping elements 6 have a relatively low stiffness.

The longitudinal axis of the guide lever 15 extends transverse to the diagonal axes 4, 4'. Furthermore, the root point of the guide lever 15 lies between the diagonal axes 4, 4'. Thus two bearings 2, 21 lie above the root point and both the other bearings 2', 21', are located below the root point. Due to this arrangement all four damping elements 6 and the associated bearings 2, 2'; 21, 21' are loaded evenly by the self-weight of the guide clamp 15. The damping elements 6 are stressed predominantly by shear, so that a high load capacity and long lifespan are achieved. Despite the good vibration isolation even a good controllability of the working device 1 is ensured.

The joint 14 for the guide lever 15 is arranged on the topside of the console 7. The swivel axis extends parallel to the diagonal axes 4, 4' so that the operator can alter the working height by deviating the guide lever 15 in the direction of arrow 12. A minimum height can be selectively adjusted using an adjusting screw 29 that is attached to the console 7.

Figure 3:
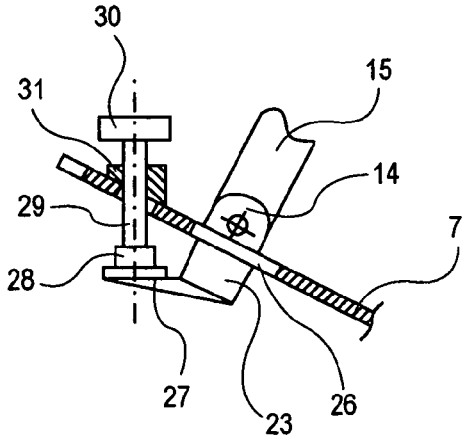
FIG. 3 a cross-section through one point of the guide lever.

In accordance with FIG. 2 and FIG. 3 the guide lever 15 is extended by an arm 23 on its root point by an opening 26 in the console 7. A stop 27 is arranged on the end of the arm 23. The stop 27 works together with the adjusting screw 29. The pivoting range of the arm 23 is limited by the end of an adjusting screw 29 that is led in a thread 31 on the console 7 and activated by hand via an adjusting knob 30. The further the end of the adjusting screw 29 is unscrewed from the console 7 downwards the steeper is the attack angle of the arm 23 and with it the minimal working height of the guide lever 15. The guide lever 15 is protected by its self-weight via the arm 23 on the adjusting screw 29. It is possible to conveniently deviate the guide lever 15 upward via the joint 14 so that it can be easily folded e.g., in a dangerous situation.

On the free end of the adjusting screw 29 is an elastic buffer (rebound stop) 28 that further reduces the vibrations of the working machine that are damped by the elastically cushioned console 7. This double damping ensures particularly good vibration isolation. Since the stop 27 and the adjusting screw 29 lie in front of the swivel axis of the guide lever 15 and partly below the console 7, they are also well protected from mechanical damages during operation in the building site and during transportation.

Figure 4:
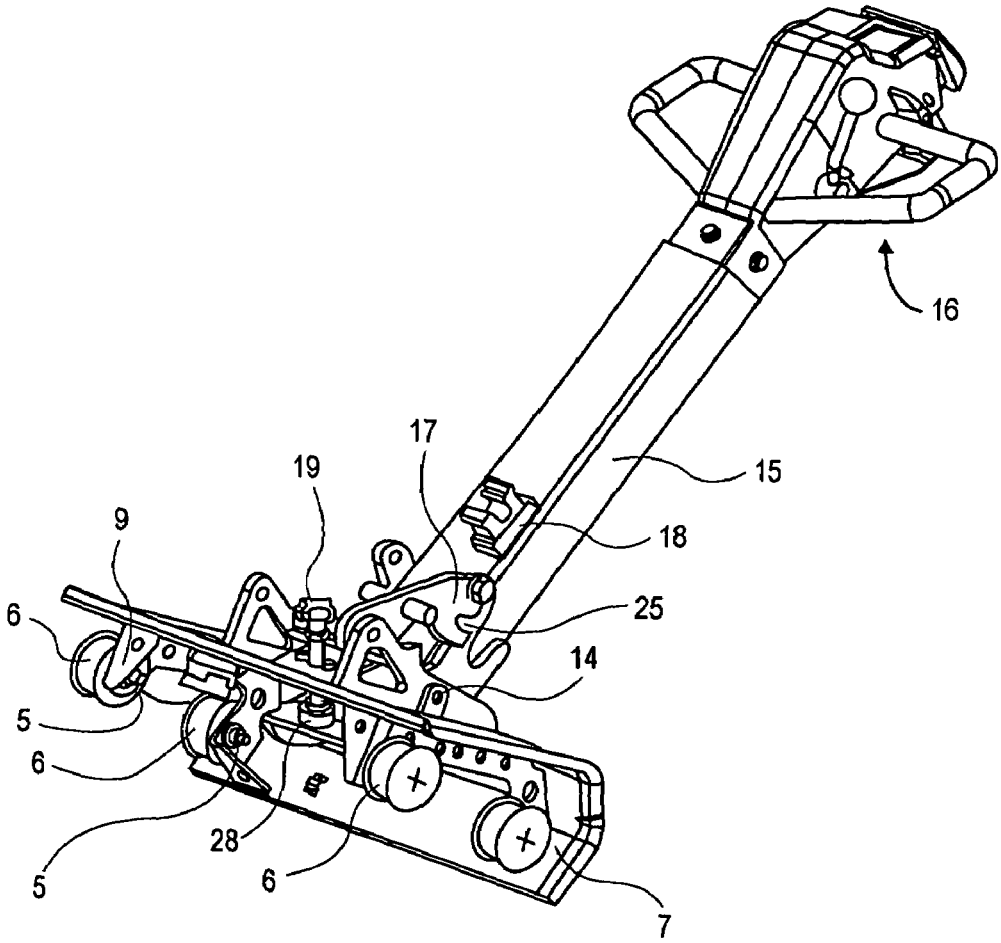
FIG. 4 a perspective view of the guide lever according to FIG. 2 in a folded position.
Figure 5:
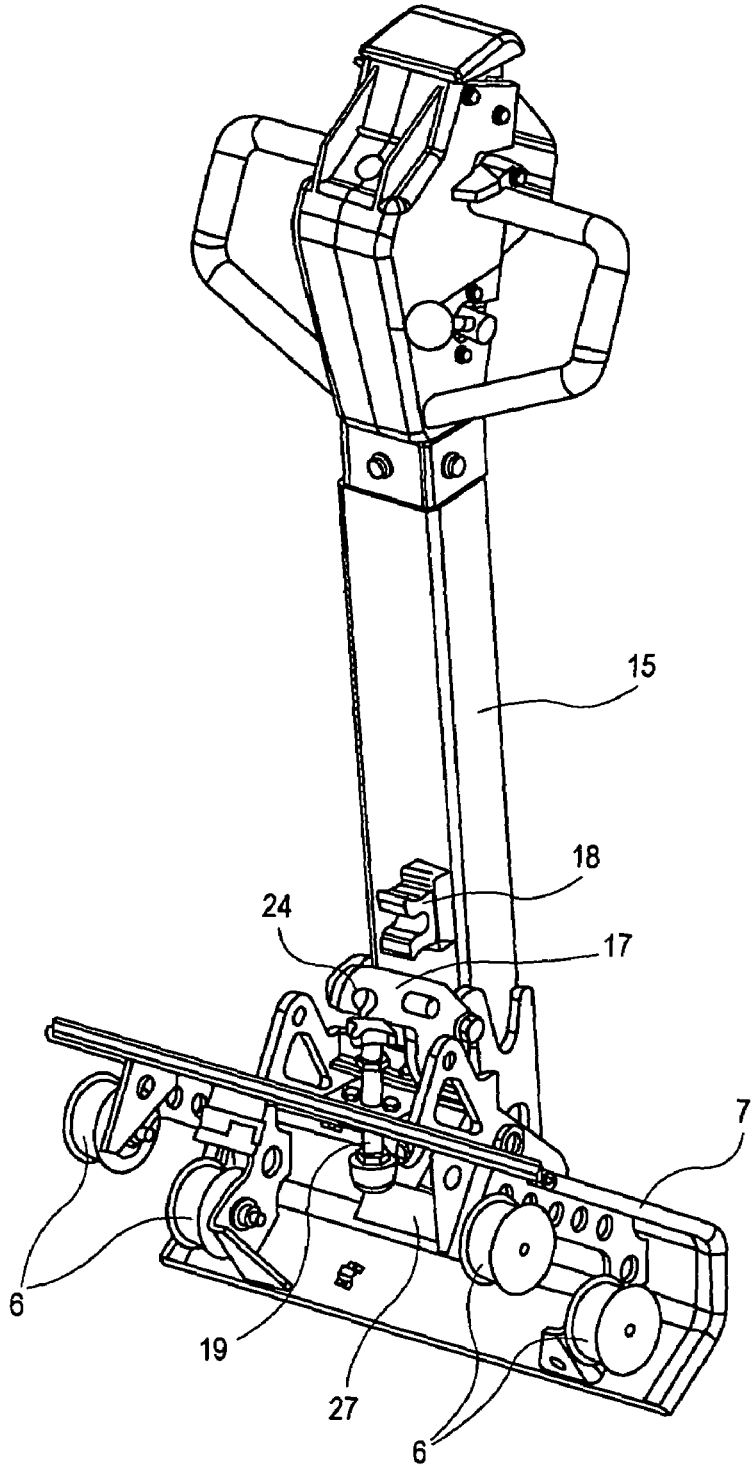
FIG. 5 a perspective view of the guide lever in a transport position.

The FIGS. 2, 4 and 5 illustrate a bolt 17 with which the guide lever 15 can be locked in at least one further working position in accordance with FIG. 4 and fixed in a transport position, that is illustrated in FIG. 5. In FIG. 2 the bolt 17 is fixed in pivoted rest position via a clamp mounting 18 on the guide lever 15, as is the case during normal working operation.

The bolt 17 has two bolt recesses 24, 25 that are located at a distance from each other and that determine the next working position and the transport position. FIG. 4 illustrates how the bolt 17 is reversed downward and the first bolt recess 24 is hooked on a pin 32 that is located on the side of the console. This bolting mechanism of the guide lever 15 is activated if the operator wants to exert greater forces on the working device for pushing or pulling it.

In FIG. 5 the bolt 17 is hooked via its second bolt recess 25 to the pin 32, by which the guide lever 15 is fixed in its steepest position for transport purposes.

The claimed invention is:

1. A hand-operated, automotive working device with a vibratory damping guide lever, for operation with a vibrating plate or a vibrating roller wherein it has an elastic damping element on each of four junctures distributed in the arrangement, and wherein all four damping elements are connected on an inner face of a console, and wherein the guide lever is arranged on the consoles, wherein the working device further comprises:

a first and second set of bearings configured to retain the damping elements;

a first set of counter bearings connected to the first set of bearings configured to retain the damping elements; and a second set of counter bearings connected to the second set of bearings configured to retain the damping elements, wherein the first and second set of bearings configured to retain the damping elements are connected to the respective sets of counter bearings by the four damping elements.

2. The working device in accordance with claim 1 wherein the junctures are located in the corners of a rectangle such the distance between the junctures alone a diagonal axis the junctures is as large as possible.

3. The working device in accordance with claim 1 wherein a root point of the guide lever lies within the rectangle.

4. The working device in accordance with claim 1 wherein the first and second set of bearings configured to retain the damping elements and the first and second sets of counter bearings are located opposite each other on the junctures and at a distance from each other, and further comprising a damping element arranged between the bearings of the working device and the bearings on the side console.

5. The working device in accordance with claim 1 wherein the damping elements are designed as rubber pads.

6. The working device in accordance with claim 1 wherein the guide lever is connected for adjusting its working height via a joint to the console.

7. The working device in accordance with claim 6 wherein different angular positions of the guide lever can be adjusted via a bolt or an adjusting screw.

8. The working device in accordance with claim 7 wherein the guide lever has an arm with a stop that limits the pivoting angle, and wherein the stop works together with the adjusting screw that is located on the side of the console and the arm is an extension of the guide lever over guide lever swivel axis.

9. The working device in accordance with claim 8 wherein the contact zone of the stop and of the adjusting screw is vibratory damped.

* * * * *